US007690544B2

(12) United States Patent
Zaruba

(10) Patent No.: US 7,690,544 B2
(45) Date of Patent: Apr. 6, 2010

(54) AUTOMATIC COILING MACHINE

(76) Inventor: Thomas Tuck Zaruba, 8208 Poplar Ave., Juneau, AK (US) 99801

( * ) Notice: Subject to any disclaimer, the term of this patent is extended or adjusted under 35 U.S.C. 154(b) by 23 days.

(21) Appl. No.: 12/155,934

(22) Filed: Jun. 11, 2008

(65) Prior Publication Data

US 2009/0127526 A1 May 21, 2009

Related U.S. Application Data

(60) Provisional application No. 60/988,875, filed on Nov. 19, 2007.

(51) Int. Cl.
*B65H 20/00* (2006.01)

(52) U.S. Cl. ..... 226/186; 242/472.5

(58) Field of Classification Search ..... 226/184, 226/181, 176, 177, 188, 186, 187; 242/615.3, 242/472.5, 564.4; 254/371, 336, 338
See application file for complete search history.

(56) References Cited

U.S. PATENT DOCUMENTS

| | | | | | |
|---|---|---|---|---|---|
| 1,201,434 | A | * | 10/1916 | Bohle | 242/403 |
| 2,194,879 | A | * | 3/1940 | Von Mihaly et al. | 242/548.2 |
| 2,888,214 | A | | 5/1959 | Wilke | |
| 2,930,539 | A | | 3/1960 | Bremer | |
| 2,936,509 | A | * | 5/1960 | Martin | 53/116 |
| 2,944,755 | A | * | 7/1960 | Foster | 242/615.1 |
| 3,034,767 | A | | 5/1962 | Gordon | |
| 3,072,384 | A | * | 1/1963 | Apichell | 242/615.2 |
| 3,692,254 | A | * | 9/1972 | Ebert et al. | 242/129.62 |
| 3,750,970 | A | | 8/1973 | Tremoulet, Jr. | |
| 3,765,614 | A | * | 10/1973 | Bartl et al. | 242/361.4 |
| 3,819,155 | A | | 6/1974 | Smith | |
| 3,903,632 | A | | 9/1975 | Tison et al. | |
| 4,026,483 | A | | 5/1977 | Skalleberg | |
| 4,107,865 | A | | 8/1978 | Alex | |
| 4,165,830 | A | * | 8/1979 | Svendsen | 226/187 |
| 4,234,164 | A | | 11/1980 | Ruark | |
| 4,354,667 | A | * | 10/1982 | Svendsen | 254/332 |
| 4,511,122 | A | * | 4/1985 | Svendsen | 254/332 |
| 4,588,166 | A | | 5/1986 | Cloud | |
| 4,644,682 | A | | 2/1987 | Cloud | |
| 5,566,901 | A | * | 10/1996 | Wilder | 242/532.6 |
| 5,853,134 | A | | 12/1998 | Kleppesto et al. | |

* cited by examiner

*Primary Examiner*—John Q Nguyen
*Assistant Examiner*—Juan J Campos
(74) *Attorney, Agent, or Firm*—Litman Law Offices, Ltd; Richard J. Apley

(57) ABSTRACT

The automatic coiling machine is a device for automatically coiling an elongated flexible element, such as a fishing line. The automatic coiling machine includes a housing adapted for mounting to a support surface, such as a wall of a boat. The housing includes at least one sidewall. A drive roller is rotatably mounted to the sidewall by a drive shaft. A drive system, such as a motor, is mounted to the sidewall for selectively and controllably driving rotation of the drive shaft and, thus, the drive roller. An idler roller is rotatably mounted to the sidewall adjacent the drive roller and contacting the drive roller so that rotation of the drive roller drives rotation of the idler roller. The sidewall is angled so that an axis of rotation of the drive roller is angled with respect to the axis of rotation of the idler roller.

17 Claims, 2 Drawing Sheets

AUTOMATIC COILING MACHINE

CROSS-REFERENCE TO RELATED APPLICATION

This application claims the benefit of U.S. Provisional Patent Application Ser. No. 60/988,875, filed Nov. 19, 2007.

BACKGROUND OF THE INVENTION

1. Field of the Invention

The present invention relates to devices for winding rope, wire, cable, and other elongated flexible elements into a coil, and particularly to an automatic coiling machine that coils the flexible element to a desired height or diameter.

2. Description of the Related Art

Fishermen and sailors use ropes and other lines for a wide variety of nautical purposes, such as securing anchors, hauling underwater traps, and capturing large fish (particularly, longline and pot fishing). Traps, anchors and other heavy loads are typically drawn in to the ship manually or with the aid of a power winch. Such manual operation is time consuming and tiring. Although a power winch draws the line in, the line easily becomes tangled, and the line wound around a drum, and must then be unwound and manually coiled for safe storage and transport thereof.

It would be desirable to provide a system for automatically drawing and coiling a line, thus relieving fishermen and sailors of the time and energy required by manually drawing in and coiling the lines. Thus, an automatic coiling machine solving the aforementioned problems is desired.

SUMMARY OF THE INVENTION

The automatic coiling machine is a device for automatically coiling an elongated flexible element, such as a rope, wire, cable, hose, or the like. The machine includes a housing having an upper wall and at least one sidewall. A motor is mounted on the exterior of the sidewall and a pneumatic drive wheel or roller is mounted on the interior of the sidewall on a drive shaft mounted for rotation in the sidewall. A chain and sprocket coupling connects the motor with the drive shaft to provide for selective rotation of the drive shaft.

An idler roller is rotatably mounted on the sidewall below and forward of the drive roller and contacts the drive roller so that rotation of the drive roller causes rotation of the idler roller. Additionally, the forward portion of the sidewall is angled so that the axis of rotation of the drive roller is angled with respect to the axis of rotation of the idler roller.

Additionally, a substantially U-shaped guide or fairlead having vertical rollers is mounted on the sidewall, being positioned above and adjacent a contact intersection of the drive roller and the idler roller. A second and larger U-shaped guide or fairlead is mounted forward of the sidewall-mounted fairlead. In use, a line to be coiled passes through the substantially U-shaped guides and between the drive roller and the idler roller to form a coil beneath the housing and rollers. The height or diameter of the coil may be adjusted by regulating the amount of pneumatic pressure in the drive roller.

The above-described system is relatively small and portable, allowing it to be attached to, and used with, relatively small ships, or transferred between different types of vessels. These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
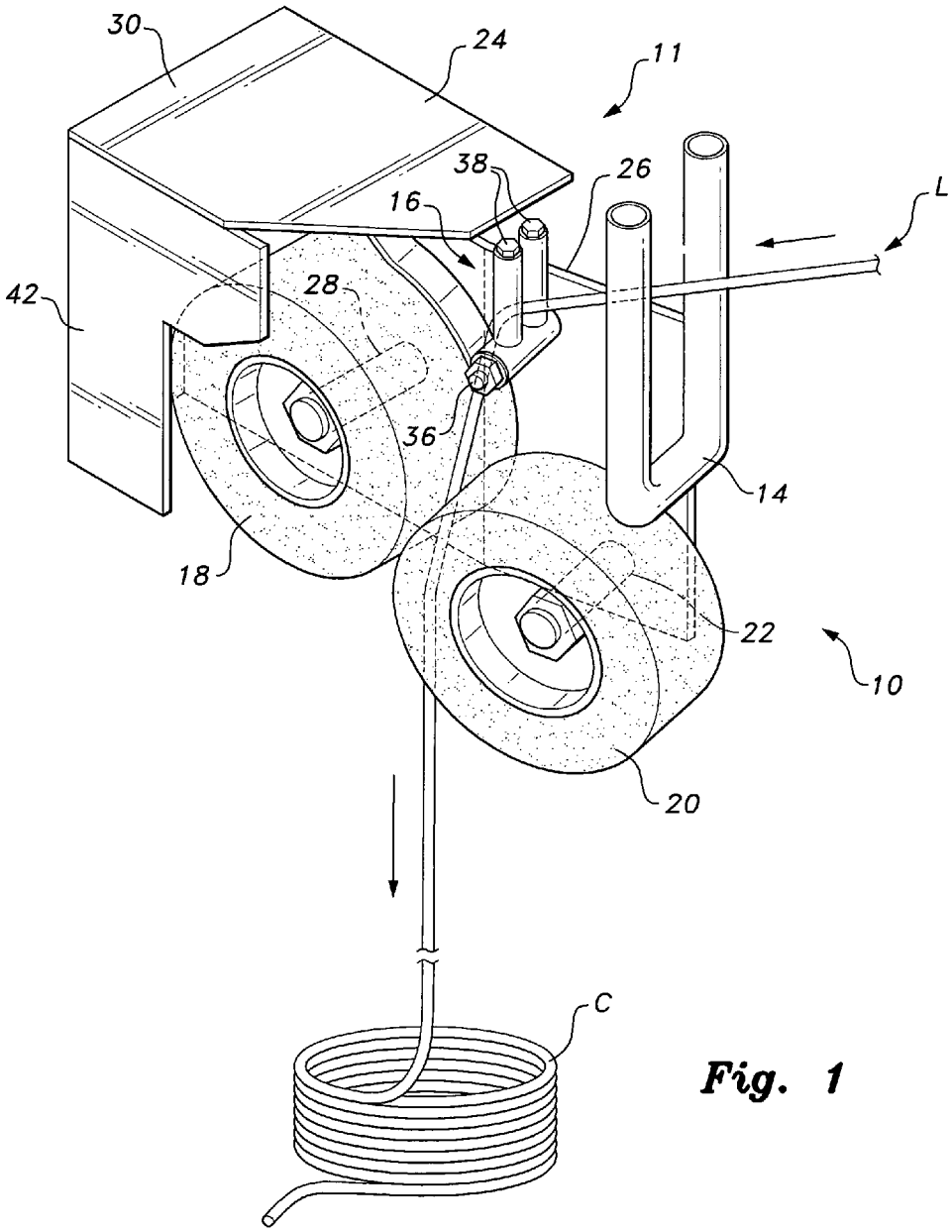
FIG. 1 is a perspective view of an automatic coiling machine according to the present invention.
Figure 2:
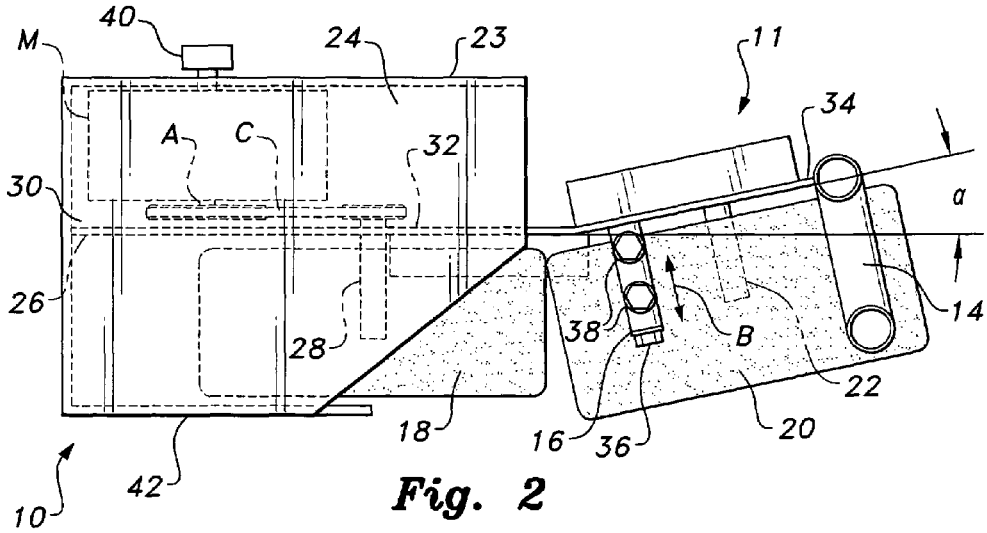
FIG. 2 is a top view of the automatic coiling machine according to the present invention.

As shown in FIG. 1, the automatic coiling machine 10 is a device for automatically coiling an elongated flexible element or line L, such as a nautical rope, a cable, a wire, a hose, or the like. The automatic coiling machine 10 includes a housing 24 adapted for mounting to a support surface, such as a wall or the hull of a boat. The housing 24 includes an upper wall 30 and at least one sidewall 26. The sidewall 26 has forward and rear portions 34, 32, respectively, as best shown in FIG. 2. A drive wheel or roller 18 is rotatably mounted to the sidewall 26 by a drive shaft 28. The drive shaft 28 is rotatable in a bearing mounted in the sidewall 26. The drive shaft 28 extends through the sidewall 26, the drive roller 18 being mounted on the first end of the drive shaft 28, and the second end of the drive shaft having a sprocket mounted thereon. Housing 24 may be formed from any suitable material, such as wood, metal, metal alloys, fiberglass, nylon, carbon fiber, plastic or stainless steel. Preferably, housing 24 and the elements to be described in detail below are formed from materials that are resistant to damage from water and the elements. Further, it should be understood that the dimensions and positioning of the rollers are shown for exemplary purposes only.

Figure 3:
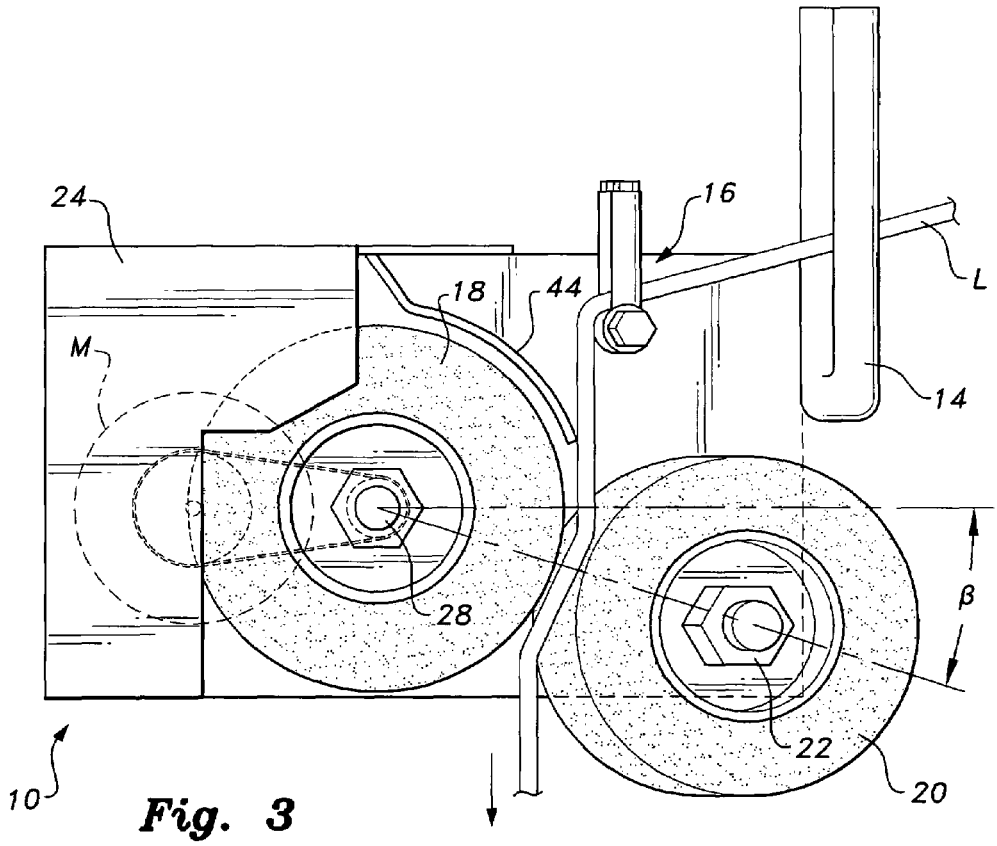
FIG. 3 is a front perspective view of the automatic coiling machine according to the present invention.

In the exemplary embodiment illustrated in FIGS. 1-3, the housing 24 includes upper wall 30, which is mounted on an upper edge of the sidewall 26. As best shown in FIG. 2, sidewall 26 extends centrally (along the lateral direction) beneath the upper wall 30, with the drive roller 18 being positioned on one side of the sidewall 26 (and being at least partially covered and protected by upper wall 30), and a drive system, to be described in greater detail below, positioned on the opposite side of sidewall 26. The drive shaft 28 extends through the wall 26, as shown in FIG. 2. A front wall 42 may further be provided, offering additional protection and coverage for at least a portion of drive roller 18. Drive roller 18 is a pneumatic wheel, and may be made from plastic, vinyl, nylon, or rubber. However, vulcanized synthetic rubber is preferred.

As noted above, a drive system, such as a motor M, is mounted on the opposite side of sidewall 26 for selectively and controllably driving rotation of the drive shaft 28 and, thus, the drive roller 18. A controller 40 is preferably provided and is in communication with motor M, allowing the user selective control over the actuation and power output of motor M. Controller 40 may be in the form of a switch or the like. Motor M and drive shaft 28 are positioned adjacent the rear portion 32 of the sidewall 26. Motor M is preferably protected from the environment by a rear wall 23 depending from upper wall 30, as shown in FIG. 2. Although controller 40 is shown mounted on rear wall 23, it should be understood that controller 40 may be positioned in any suitable location on housing 24. Motor M is shown for exemplary purposes only, and the system may be driven by any user-controllable source, such as an electric motor, a hydraulic drive system, a pneumatic drive system, an internal combustion engine, or a manual crank or drive system. Further, it should be understood that the positioning of motor M is shown for exemplary purposes only, and that motor M and the linkage to drive shaft 28 may be positioned in any suitable locations within housing 24.

The shaft A of motor M is linked to drive shaft 28 through the usage of any suitable mechanical coupling, but preferably a sprocket is mounted on shaft A and coupled to the sprocket on drive shaft 28 by a chain C, forming a chain and sprocket coupling, as shown in FIG. 2. Any suitable linkage may be utilized, such as, for example, a chain and sprocket assembly, direct coupling, a gear drive, a worm gear, a closed belt or a pulley. Driven rotation of chain C causes rotation of drive shaft 28, which, in turn, drives roller 18. It should be understood that the chain and sprocket system described above is given for exemplary purposes only, and that the drive roller 18 may be driven to rotate via any suitable drive system, including but not limited to, direct interconnection with any type of motor or drive.

An idler roller 20 is rotatably mounted on sidewall 26 below and forward of the drive roller 18. Idler roller 20 is mounted on the front portion 34 of sidewall 26 and contacts the drive roller 18 so that rotation of the drive roller 18 drives rotation of the idler roller 20. Additionally, as best shown in FIG. 2, the forward portion 34 of the at least one sidewall 26 is angled so that the axis of rotation of the drive roller 18 (taken along the axis of elongated drive shaft 28) is angled with respect to the axis of rotation of the idler roller 20 (taken along the axis of elongated drive shaft 22 of idler roller 20). As shown in FIG. 2, the forward portion 34 is angled by an angle $\alpha$ with respect to the rear portion 32, when viewed from above. Sidewall 26 may be manufactured so that angle $\alpha$ may have any desired angle, depending upon the nature of line L and the dimensions of the desired coil C. Angle $\alpha$ may range between 0° and 90°, although, in the preferred embodiment, angle $\alpha$ is approximately 12°. Idler roller 20 may be formed from any suitable material, such as plastic, vinyl, fiberglass, metal, rope, carbon fiber, nylon or rubber.

Additionally, a substantially U-shaped guide or fairlead 16 is mounted to sidewall 26 and positioned above and adjacent a contact intersection of the drive roller 18 and the idler roller 20. The substantially U-shaped guide 16 includes a lower, horizontal shaft 36 and a pair of upper, vertical rollers 38, with the pair of upper, vertical rollers 38 each being rotatably mounted on the lower, horizontal shaft 36. The pair of upper, vertical rollers 38 are spaced apart from one another by a user-selectable and adjustable width (indicated by directional arrow B of FIG. 2). In use, the line L to be coiled passes through the substantially U-shaped guide 16 and between the drive roller 18 and the idler roller 20 to form a coil C beneath the housing and rollers. The adjustable width between vertical rollers 38 allows for a variety of thicknesses of line to be coiled by system 10, or for the coiling of line having, for example, knots formed in the length thereof. It should be understood that guide 16 is shown for exemplary purposes only, and that any suitable guide for line L may be utilized.

As best shown in FIGS. 1 and 3, the axis of rotation of the drive roller 18 is preferably positioned above the axis of rotation of the idler roller 20. In FIG. 3, a line segment joining the axes of rollers 18 and 20 is angled from the horizontal by an angle $\beta$. Rollers 18, 20 may be mounted such that angle $\beta$ may have any desired angle, depending upon the nature of line L and the dimensions of the desired coil C. In the preferred embodiment, $\beta$ is approximately 17°. Additionally, an auxiliary guide 14 is mounted to the forward portion 34 of the sidewall 26. It should be noted that upper wall 30 preferably only covers drive roller 18, and leaves the space above idler roller 20 free for the feeding of line L through guides 14 and 16 above the idler roller 20. As shown, the auxiliary guide 14 is positioned adjacent and above the idler roller 20. Preferably, the auxiliary guide 14 also has a substantially U-shaped contour, allowing line L to pass through the guide 14, as shown, prior to entry between the rollers 18, 20. Additionally, as shown in FIG. 2, a mount 11, may be provided on the forward portion 34 of wall 26, allowing for mounting on a wall, rail or hull. Mount 11 may be any suitable mounting structure, such as a bracket or the like.

As best shown in FIG. 3, an arcuate guide 44 is further provided. The guide 44 has upper and lower ends, with the upper end thereof being mounted to the upper wall 30 of housing 24 and extending downwardly therefrom. The arcuate guide 44 extends over and covers at least a portion of the drive roller 18, as shown, with, the lower end being positioned above the contact interface between rollers 18, 20 and being adapted for contacting the line L above the contact intersection. Further, although shown as a free coil C in FIG. 1, it should be understood that coil C may be collected within a barrel, a bucket, or other cylindrical container. The height and diameter of the coil may be adjusted by controlling the air pressure in pneumatic drive roller 18.

It should be noted that the above-described system is relatively small and portable, allowing it to be attached to, and used with, relatively small ships, or transferred between different types of vessels.

It is to be understood that the present invention is not limited to the embodiments described above, but encompasses any and all embodiments within the scope of the following claims.

I claim:

1. An automatic coiling machine, comprising:

a housing having an upper wall and at least one sidewall;

a drive roller having a substantially flat outer circumferential surface and rotatably mounted to the at least one sidewall;

means for selectively driving rotation of the drive roller;

an idler roller having a substantially flat outer circumferential surface and rotatably mounted to the at least one sidewall below and forward of the drive roller, wherein said drive roller has an axis of rotation positioned above the axis of rotation of said idler roller, the idler roller contacting the drive roller so that rotation of the drive roller drives rotation of the idler roller, wherein the at least one sidewall includes forward and rear portions, the forward portion being angled so that the axis of rotation of said drive roller is angled with respect to the axis of rotation of said idler roller thereby creating a V-shaped opening between the circumferential surfaces of the drive and idler rollers; and a substantially U-shaped fairlead mounted to the at least one sidewall, the fairlead being positioned above and adjacent a contact intersection of the drive roller and the idler roller;

wherein an elongated flexible element to be coiled passes through the fairlead and within the v-shaped opening between the drive roller and the idler roller and is collected in a coil below the rollers.

2. The automatic coiling machine as recited in claim 1, wherein the upper wall of said housing extends over and covers the rear portion of the at least one sidewall, the forward portion thereof being uncovered.

3. The automatic coiling machine as recited in claim 1, wherein said fairlead comprises a lower, horizontal shaft and a pair of upper, vertical rollers, the pair of upper, vertical rollers each being rotatably mounted on the lower, horizontal shaft.

4. The automatic coiling machine as recited in claim 3, wherein the pair of upper, vertical rollers are spaced apart from one another by a user-selectable and adjustable width.

5. The automatic coiling machine as recited in claim 1, further comprising an auxiliary guide mounted to the at least one sidewall, the auxiliary guide being positioned adjacent and above said idler roller.

6. The automatic coiling machine as recited in claim 5, wherein the auxiliary guide is substantially U-shaped.

7. The automatic coiling machine as recited in claim 1, further comprising an arcuate guide having upper and lower ends, the upper end thereof being mounted to the upper wall of said housing, the arcuate guide extending over and covering at least a portion of said drive roller, the lower end being adapted for contacting the flexible element above the contact intersection.

8. The automatic coiling machine as recited in claim 1, further comprising a drive shaft having first and second ends, the drive shaft extending through and being rotatably mounted in the at least one sidewall, said drive roller being mounted on the first end of the drive shaft, the second end thereof being rotatably driven by said means for selectively driving rotation of said drive roller.

9. The automatic coiling machine as recited in claim 8, wherein said means for selectively driving rotation of said drive roller comprises a user-actable motor mounted on said housing and a coupling between the user-actable motor and the drive shaft.

10. The automatic coiling machine as recited in claim 9, wherein said coupling comprises a chain and sprocket mechanism connecting said motor and said drive shaft.

11. An automatic coiling machine, comprising:

a housing having an upper wall and at least one sidewall, the at least one sidewall including forward and rear portions;

a drive roller having a substantially flat outer circumferential surface and rotatably mounted to the at least one sidewall;

means for selectively driving rotation of the drive roller;

an idler roller having a substantially flat outer circumferential surface and rotatably mounted to the at least one sidewall adjacent the drive roller and contacting the drive roller so that rotation of the drive roller drives rotation of the idler roller, wherein said drive roller has an axis of rotation positioned above the axis of rotation of said idler roller such that a line segment joining the axes of the rollers is angled at about 17° to the horizontal, the forward portion of the at least one sidewall being angled so that an axis of rotation of the drive roller is angled at about 12° with respect to an axis of rotation of the idler roller and defining a V-shaped opening between the circumferential surfaces of the drive and idler rollers; and a substantially U-shaped fairlead mounted to the at least one sidewall, the substantially U-shaped guide being positioned above and adjacent a contact intersection of the drive roller and the idler roller;

whereby an elongated flexible element to be coiled passes through the fairlead and within the V-shaped opening between the drive roller and the idler roller, collecting in a coil below the rollers.

12. The automatic coiling machine as recited in claim 11, wherein the upper wall of said housing extends over and covers the rear portion of the at least one sidewall, the forward portion thereof being uncovered.

13. The automatic coiling machine as recited in claim 11, wherein said fairlead includes a lower, horizontal shaft and a pair of upper, vertical rollers, the pair of upper, vertical rollers each being rotatably mounted on the lower, horizontal shaft.

14. The automatic coiling machine as recited in claim 13, wherein the pair of upper, vertical rollers are spaced apart from one another by a user-selectable and adjustable width.

15. The automatic coiling machine as recited in claim 11, further comprising an auxiliary guide mounted to the at least one sidewall, the auxiliary guide being positioned adjacent and above said idler roller.

16. The automatic coiling machine as recited in claim 15, wherein the auxiliary guide has a substantially U-shaped contour.

17. The automatic coiling machine as recited in claim 11, wherein said drive roller comprises a pneumatic wheel having a pressure, the pressure being adjustable in order to adjust height and diameter of the coil being collected.

* * * * *